US009322126B2

(12) United States Patent
Albayrak et al.

(10) Patent No.: US 9,322,126 B2
(45) Date of Patent: Apr. 26, 2016

(54) DOMESTIC APPLIANCE COMPRISING A THERMOELECTRIC HEAT PUMP

(75) Inventors: Hasan Gökcer Albayrak, Berlin (DE); Klaus Grunert, Berlin (DE); Günter Steffens, Dallgow-Döberitz (DE); Andreas Stolze, Falkensee (DE)

(73) Assignee: BSH Hausgeraete GmbH, Munich (DE)

( * ) Notice: Subject to any disclaimer, the term of this patent is extended or adjusted under 35 U.S.C. 154(b) by 1832 days.

(21) Appl. No.: 12/086,465

(22) PCT Filed: Nov. 29, 2006

(86) PCT No.: PCT/EP2006/069037

§ 371 (c)(1),
(2), (4) Date: Jun. 12, 2008

(87) PCT Pub. No.: WO2007/068588

PCT Pub. Date: Jun. 21, 2007

(65) Prior Publication Data

US 2009/0049843 A1 Feb. 26, 2009

(30) Foreign Application Priority Data

Dec. 16, 2005 (DE) ..... 10 2005 060 355

(51) Int. Cl.
*D06F 58/20* (2006.01)
*F04B 37/06* (2006.01)
(Continued)

(52) U.S. Cl.
CPC ..... *D06F 58/206* (2013.01); *F04B 37/06* (2013.01); *F04D 17/16* (2013.01); *F04D 25/08* (2013.01); *F25B 21/02* (2013.01)

(58) Field of Classification Search
CPC ..... F04D 17/16; F04D 25/08; F04B 37/06; F25B 21/02; D06F 58/206
USPC ..... 62/3.1, 3.2, 3.3, 3.7, 129; 34/595; 236/1 F
See application file for complete search history.

(56) References Cited

U.S. PATENT DOCUMENTS

| | | | | |
|---|---|---|---|---|
| 5,724,750 | A * | 3/1998 | Burress | 34/267 |
| 2006/0168840 | A1 | 8/2006 | Paintner | |
| 2007/0089763 | A1 | 4/2007 | Paintner | |

FOREIGN PATENT DOCUMENTS

| | | |
|---|---|---|
| DE | 1 410 206 | 10/1968 |
| DE | 6926182 U | 12/1969 |

(Continued)

OTHER PUBLICATIONS

Solbrekken et al., Thermal Management of Portable Electronic Equipment Using Thermoelectric Energy Conversion, 2004, IEEE Publication, Inter Society Conference on Thermal Phenomena.*

(Continued)

*Primary Examiner* — Frantz Jules
*Assistant Examiner* — Brian King
(74) *Attorney, Agent, or Firm* — James E. Howard; Andre Pallapies

(57) ABSTRACT

A domestic appliance, which may be a tumble dryer, includes a thermoelectric heat pump; at least one series of Peltier elements operationally associated with the heat pump and driven by a supply voltage for producing heat during appliance operation wherein the resistance of the Peltier elements increases with increasing temperature and wherein a threshold temperature for the Peltier elements is defined; and a heat flow path for dissipating heat produced by the Peltier elements wherein at a maximum temperature of the Peltier elements above a normal operating temperature and below the threshold temperature the power of the heat dissipated through the heat flow path is substantially equal to the electrical power drawn by the Peltier elements from the supply voltage.

40 Claims, 1 Drawing Sheet

(51) Int. Cl.

| | |
|---|---|
| ***F04D 17/16*** | (2006.01) |
| ***F25B 21/02*** | (2006.01) |
| ***F04D 25/08*** | (2006.01) |

(56) References Cited

FOREIGN PATENT DOCUMENTS

| | | |
|---|---|---|
| DE | 1 922 705 | 11/1970 |
| DE | 198 13 924 | 9/1999 |
| DE | 201 01 641 U | 6/2002 |
| DE | 10 2004 055 926 | 5/2006 |
| EP | 1 342 828 | 9/2003 |
| JP | 8-57194 | 3/1996 |

OTHER PUBLICATIONS

International Search Report PCT/EP2006/069037.
Article entitled: Quick-Cool Peltier Elements which was downloadable on Nov. 25, 2005 from the internet address http:///www.quick-ohm.de/waerme/download/Erlaeuterung-zu-Peltierelementen/pdf.
Article entitled: Installation of Modules which was downloadable on Nov. 25, 2005 from the internet address http://www.quick-ohm.de/waerme/download/Einbau.pdf.

* cited by examiner

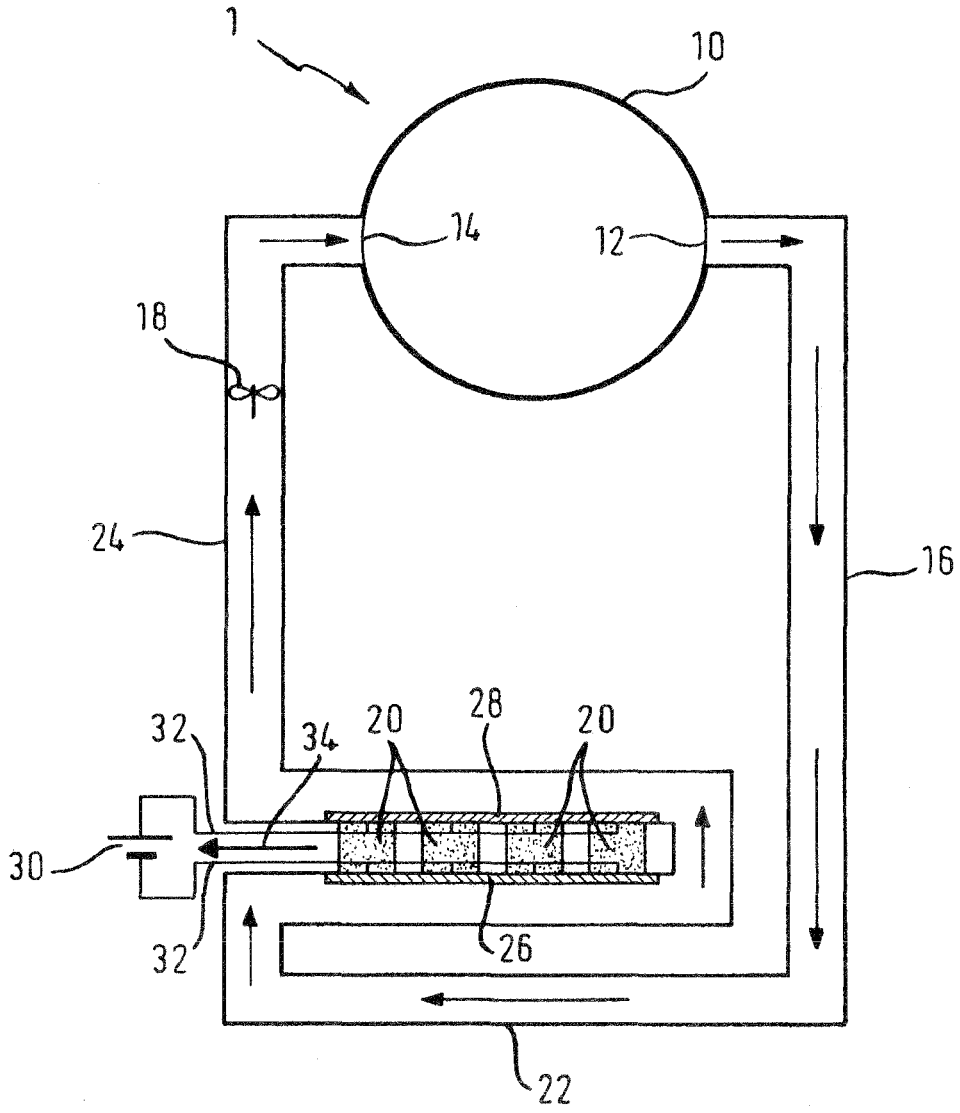
1
10
14
12
18
24
16
32
34
20
28
20
30
32
26
22

DOMESTIC APPLIANCE COMPRISING A THERMOELECTRIC HEAT PUMP

BACKGROUND

The invention relates to a domestic appliance comprising a thermoelectric heat pump, which contains at least one series arrangement of Peltier elements that can be driven with a constant supply voltage, the resistance of which elements increases with increasing temperature and for which a threshold temperature for the Peltier elements is specified.

From a document that was downloadable on Nov. 25, 2005 from the internet the construction and method of operation of a Peltier element having the previously described construction is known. The half-elements of this Peltier element are formed as columns or blocks and consist of doped semiconductors as the active materials. The semiconductors are specifically bismuth telluride and a p-type doped and an n-type doped semiconductor are employed. A half-element of p-type doped semiconductor and a half-element of n-type doped semiconductor are each connected together on one side by a small circuit board, also known as a metal bridge and on another side, opposite the stated one side, each connected by a further small circuit board to a further half-element or to a connection contact for connection of the Peltier element to an electrical network.

Further information on the principles, application-related selection and assembly of Peltier elements are available from documents that were downloadable on 25 Nov. 2005.

DE 1 410 206 A refers to a domestic appliance in the form of a washing machine in which the articles of washing are not only washed but can also be dried. The document shows a number of alternatives for the additional equipment required for this; in particular an electrical heating device for heating a flow of air for drying the washing and a simple heat exchanger for cooling the warmed flow of air after its contact with the washing can be provided, but the heater and the cooler can also be parts of a heat pump. The heat pump can be a heat pump that works with Peltier elements to make use of the thermoelectric effect; in this case the heat pump is called a "thermoelectric heat pump".

A domestic appliance for the drying of washing referred to in an English abstract of JP 08 057 194 A from the collection "Patent Abstracts of Japan" has, in a system of ducts, in addition to a heater and a cooler, both of which are part of a thermoelectric heat pump, an additional heat exchanger connected upstream of the cooler for cooling the air flow from the items of washing and a further heating device connected downstream of the heater for further heating the air flow before it impinges on the items of washing.

A domestic appliance in the form of a tumble dryer with a thermoelectric heat pump is known from DE 69 26 182 U. Normally the resistance of all Peltier elements increases with increasing temperature. In the case of Peltier elements a threshold temperature is preset by the use of solder that can melt. For Peltier elements a threshold temperature of 150° C. is usual.

Such a construction can cause a problem when there is a fault in the operation of the domestic appliance, for example a failure of a blower fan, excessive drying of the washing or an excessive amount of lint in the air passages. If appropriate safety measures are not provided in such a case, the heat pump can be destroyed by overheating. When such overheating occurs, a solder joint in a Peltier element can be damaged and thereby its electrical contact properties affected; it is also possible that metal diffuses from an overheated solder joint into a semiconductor material of the Peltier element, causing a long-term impairment to its operation.

In a tumble dryer or an appropriately equipped washing machine, washing is normally dried in a drum to which hot air is supplied.

The hot air becomes saturated with evaporating water and the resulting humid air is guided toward the thermoelectric heat pump. On a cold side of this heat pump water condenses out of the humid air and is eliminated from it. The air is guided toward a hot side of this heat pump where it is reheated in order to be supplied again to the drum. A fault can occur in this operation. For example, it can occur that, as a result of blockage in the airways such as by items of washing or accumulations of lint, sufficient air no longer flows past the thermoelectric heat pump. The abnormal operating condition can also arise that the tumble dryer should stop on its own because the washing is dry or the drum is empty but the tumble dryer continues to run.

In each of these cases the Peltier elements of the thermoelectric heat pump become heated above their normal operating temperature, which is usually between 60° C. and 100° C. It is easily possible that their threshold temperature is exceeded, resulting in a failure of the modules and furthermore a certain risk of fire can arise.

SUMMARY

An object of the invention is to design a domestic appliance of the type stated in the introduction in such a way that it remains intact and safe even when there is an abnormal operating condition. This object is achieved by a domestic appliance of this type having the features described herein.

According to the invention, heat can be dissipated from each Peltier element through a heat-flow path. This is a separate heat-flow path that differs from the usual heat sink in the heating of the air on the hot side of the thermoelectric heat pump. The heat-flow path is designed in such a way that with increasing temperature before the threshold temperature is reached the power in the dissipated heat is equal to the electrical power drawn from the constant supply voltage by the Peltier elements.

The invention is based on the recognition that the Peltier elements no longer have to be protected by thermal insulation but that on the contrary a heat-flow path must be provided that dissipates heat from them. This heat flow with power $P_{therm}$ is different from the heat flow on the hot side of the heat pump. It carries the heat that flows away through structural components of the heat pump and adjacent components of the tumble dryer. In the present case this heat flow is used to achieve complete operational safety of the heat pump. According to the invention this maximum temperature is lower than the threshold temperature that the Peltier elements are permitted to reach as a maximum. When $P_{therm}$ becomes equal to $P_{el}$, the flows of heat to and from the full set of Peltier elements become equal and the maximum temperature, at which the two powers $P_{el}$ and $P_{therm}$ are in equilibrium, can now not be exceeded. Through the provision of the additional heat-flow path the thermoelectric heat pump becomes intrinsically safe, i.e. no further safety measures are required for preventing the temperature threshold from being exceeded. The power input and the resistance of the Peltier elements on one side (in which the resistance can be determined by the number of Peltier elements) are in equilibrium with the power $P_{therm}$ that can be removed through the additional heat-flow path.

From the fortunate fact that the resistance of a Peltier element increases with increasing temperature, the electrical power drawn decreases with increasing temperature. By this means, the power of the heat to be dissipated in an emergency situation is lower than the electrical power consumed in normal operation. The invention prescribes clearly, on the one hand, how to dimension the heat-flow path and on the other hand the relationship to it required by the electrical power of the Peltier elements. Naturally, with a fixed heat-flow path, the electrical power to be drawn by the Peltier elements can be modified in order to meet the requirements according to the invention. For example, the number of Peltier elements can be increased in order to increase the resistance of the Peltier elements and thereby reduce the power drawn, in order to comply with the requirement according to the invention for a specific heat-flow path.

In normal operation the preferred electrical power of the heat pump is between 800 W and 1500 W, specifically 1000 W, with an operating temperature of the heat pump between 60° C. and 100° C., specifically at 90° C. In an emergency the resistance increases sharply as a result of the temperature rise with the result that at a temperature that can no longer be exceeded, preferably between 120° C. and 150° C., specifically 120° C., the electrical power is only about one half.

The power of the dissipated heat at the temperature where it is equal to the electrical power is preferably between 450 W and 700 W, preferred value 600 W.

With the assumption that the heat to be drawn through the heat-flow path comes into an environment at approximately 20° C. and the heat that can be drawn through the heat-flow path is proportional to the temperature difference across the heat-flow path, the result from the above considerations is that in normal operation the heat-flow path of the domestic appliance removes only a few hundred Watts of heat, specifically approximately one quarter of the electrical power normally taken by the heat pump.

It is advantageous if the domestic appliance has in addition to the heat-flow path at least one additional thermal leakage path, and it is furthermore advantageous that the heat-flow path and this at least one additional thermal leakage path are designed for the removal of heat with a power that is at least equal to the power that the Peltier elements draw at operating temperature. A prerequisite for operation in a stationary state is thereby satisfied, since such operation in a stationary state requires that the entire power taken by the heat pump (and likewise power that may be introduced into the air circulation in the heat exchanger) is removed. The heat removed through the heat-flow path counts in a corresponding heat removal balance as a relatively small amount that is easily accounted for by the provision of further necessary thermal leakage paths.

The stated numerical value of the power of the heat to be dissipated makes it clear that extensive cooling mechanisms may be required for forming the heat-flow path, that cooling fins may need to be provided etc.

DETAILED DESCRIPTION

An exemplary embodiment in accordance with a preferred embodiment of the invention will now be described with reference to the drawing, wherein the figure represents schematically a domestic appliance in the form of a tumble dryer.

The tumble dryer 1 contains a drum 10 from which air can be extracted through an air exit opening 12 and into which air can be introduced through an air entry opening 14. The air moves from the air exit opening 12 into the pipe 16, being drawn by means of a fan 18. The air is guided in the pipe 16 and through the pipe 22 to an arrangement of Peltier elements 20. The Peltier elements 20 (represented here as square blocks) are disposed in a row. A supply voltage that provides the electrical power $P_{el}$ is connected to the Peltier elements 20. From the Peltier elements 20 the air travels through the pipe 24, via the fan 18, through the air entry opening 14 and back into the drum 10.

The air sucked into pipe 16 becomes laden with moisture from the items of washing (not shown) contained in the drum 10. This moisture condenses on a cold side 26 of the Peltier elements 20, which cold side 26 is formed from a heat transfer device that is thermally coupled to the Peltier elements 20 and in particular is provided with fins. The condensed moisture is collected and taken out of the air circulation by means of a device that is known and, for the sake of clarity, not represented here. From the cold side 26 the air reaches a hot side 28 of the Peltier elements 20, which hot side 28 is also formed from a heat transfer device that is thermally coupled to the Peltier elements 20 and in particular is provided with fins. The air is heated up there once more and so finally returns through the air entry opening 14 back into the drum 10. The Peltier elements 20 form, with the cold side 26 and the hot side 28, a heat pump in the tumble dryer 1.

An electrical supply 30 makes available the electrical voltage for operation of the Peltier elements 20 to which it is connected through connecting leads 32.

The system of pipes 16, 22 and 24 can be subject to faults, in particular, lint from the washing can adhere to the pipe inner surface and cause at least a partial blockage in a pipe. Therefore a filter to catch such lint (not represented here) is always provided in an actual tumble dryer 1. A fault can also be caused by a faulty, perhaps completely failing, fan 18 or excessive loading of the heat transfer devices.

It can also be possible that the drum 10 contains no items of washing or that the washing has already dried very quickly. In all these cases the air entering the pipe 16 is not laden with moisture, so that no condensing-out occurs on the cold side 26. The air continues to become hotter, whereby eventually the temperature of the Peltier elements also rises.

To avoid the situation that the Peltier elements 20 continue becoming hotter, provision is made for a heat-flow path 34 to remove from the individual Peltier elements 20 a heat flow with a power $P_{therm}$ to be specified hereinafter. This heat flow with power $P_{therm}$ ,is different from the heat flow on the hot side 28. It carries the heat that flows away through structural components of the heat pump and adjacent components of the tumble dryer 1. This heat flow is used in the present case in order to achieve complete operational safety of the heat pump.

With increasing temperature the resistance of the Peltier elements 20 increases. There is thereby a reduction in the electrical power Pei that they consume. On the other hand, the power of the dissipated heat $P_{therm}$ , increases as a consequence of the increasing temperature difference between the components of the heat pump and the environment of the tumble dryer 1 into which environment the dissipated heat finally flows. Provided that the temperature of the Peltier elements 20 nevertheless remains low enough to maintain their structural and functional integrity, an equality between $P_{therm}$ and $P_{el}$ will be reached at a specific temperature, the maximum temperature.

It is arranged that this maximum temperature is lower than the threshold temperature that the Peltier elements 20 are permitted to reach as a maximum. When $P_{therm}$ becomes equal to $P_{el}$, the flows of heat to and from the full set of Peltier elements 20 become equal and the maximum temperature, at which the two powers $P_{el}$ and $P_{therm}$ are in equilibrium, can now not be exceeded.

Through the provision of the additional heat-flow path 34, the thermoelectric heat pump becomes intrinsically safe, i.e. no additional safety measures are required to prevent the threshold temperature from being exceeded. The power input and the resistance of the Peltier elements 20 on the one hand (in which the resistance can be determined by the number of Peltier elements 20) are in equilibrium with the power $P_{therm}$ that can be removed through the additional heat-flow path 34.

While a typical operating power is 1000 W in order thereby to provide for adequate condensation of water on the cold side 26 and a heating of the air on the hot side 28 of the thermoelectric heat pump, the resistance of the Peltier elements 20 increases with temperature so much that it is adequate for $P_{therm}$ to be approximately 600 W at the threshold temperature of the Peltier elements. Correspondingly, the electrical power $P_{el}$ falls significantly with increasing temperature to this value to fulfill the condition $P_{el}=P_{therm}$, and this before the threshold temperature is reached. The usual threshold temperatures of Peltier elements are around 150° C. It is possible for the condition $P_{el}=P_{therm}$ to be already met at 120° C. to 140° C.

To enable the tumble dryer 1 to operate in a stationary state, in which the Peltier elements 20 assume their intended and design temperature between 60° C. and 100° C., specifically at approximately 90° C., the supply of heat to the tumble dryer 1 can be balanced by the removal of heat from the tumble dryer 1. Accordingly, there is provision for removal of all heat that arises in the Peltier elements in normal operation. The heat-flow path 34 alone does not provide this, but further thermal leakage paths for this are present. Among these thermal leakage paths are —not least because of the unavoidably occurring losses—the pipes 16, 22 and 24 and the drum 10. It can be necessary to provide additional thermal leakage paths, controllable if necessary —for example part of the hot air circulating in the tumble dryer 1 can be released from it and replaced by cooler air from the environment of the tumble dryer 1. In each case the heat-flow path 34 and the additional thermal leakage paths are designed for the removal of heat with a power that is at least equal to the power that the Peltier elements 20 draw at operating temperature.

It is possible to measure the electrical resistance of the arrangement of Peltier elements 20, that here has the role of a self-regulating quantity, to obtain information about the presence of abnormal situations. For this it would be necessary to incorporate a (not shown) resistance-measuring device in the circuit supplying the Peltier elements 20. Accordingly the tumble dryer 1 can be switched off early before the abnormal situation has undesirable consequences.

The invention claimed is:

1. A domestic appliance comprising:

a thermoelectric heat pump;

at least one series of Peltier elements operationally associated with the heat pump and driven by a supply voltage for producing heat during appliance operation along a first heat flow path directly from a hot side of the Peltier elements through a series of pipes to a primary target adapted to make use of the heat, wherein the resistance of the Peltier elements increases with increasing temperature, and wherein a threshold temperature for the Peltier elements is defined; and a second heat flow path, separate from the first heat flow path that heats the primary target on the hot side of the Peltier elements to directly dissipate a portion of the heat produced by the Peltier elements to environment, the second heat flow path extending directly from said hot side of the series of Peltier elements to remove heat from the appliance such that the heat of the second heat flow path bypasses and does not enter the first heat flow path, wherein at a maximum temperature of the Peltier elements above a normal operating temperature and below the threshold temperature, the power of the heat dissipated through the second heat flow path is substantially equal to the electrical power drawn by the Peltier elements from the supply voltage.

2. The domestic appliance according to claim 1 wherein the electrical power drawn by the Peltier elements is between about 800 W and about 1500 W.

3. The domestic appliance according to claim 1 wherein the electrical power drawn by the Peltier elements is about 1000W.

4. The domestic appliance according to claim 1, wherein the electrical power drawn by the Peltier elements at a maximum temperature is between about 450 W and about 700 W.

5. The domestic appliance according to claim 1, wherein the electrical power drawn by the Peltier elements at a maximum temperature is about 600 W.

6. The domestic appliance according to claim 1 wherein the operating temperature of the Peltier elements is between about 60° C. and about 100° C.

7. The domestic appliance according to claim 1 wherein the operating temperature of the Peltier elements is about 90° C.

8. The domestic appliance according to claim 1 wherein the maximum temperature is between about 120° C. and about 150° C.

9. The domestic appliance according to claim 1 wherein the maximum temperature is about 120° C.

10. The domestic appliance according to claim 1 wherein at an operating temperature the power of the heat removed through the second heat flow path is approximately one quarter of the electrical power drawn by the Peltier elements.

11. The domestic appliance according to claim 1 and further comprising at least one thermal leakage path.

12. The domestic appliance according to claim 11 wherein the second heat flow path and the thermal leakage path are configured for the removal of heat with a power that is at least equal to the power that the Peltier elements draw at operating temperature.

13. The domestic appliance according to claim 1 wherein the domestic appliance is a tumble dryer.

14. The domestic appliance according to claim 13 wherein said Peltier elements have a cold side that is adapted to directly draw heat from the first heat flow path.

15. The domestic appliance according to claim 1 wherein said Peltier elements are not protected by an insulating element.

16. The domestic appliance according to claim 13 wherein said tumble dryer includes a drum and the second heat flow path is designed to carry heat away from the dryer.

17. A domestic appliance comprising:

a thermoelectric heat pump;

at least one series of Peltier elements operationally associated with the heat pump and driven by a supply voltage for producing heat during appliance operation to heat a primary target, wherein the resistance of the Peltier elements increases with increasing temperature, and wherein a threshold temperature for the Peltier elements is defined;

a primary heat flow path defined by a series of pipes to divert a primary portion of heat from the Peltier elements to the primary target; and a secondary heat flow path to directly dissipate a secondary portion of heat produced by the Peltier elements to environment and not to a treatment chamber, wherein at a maximum temperature of the Peltier elements above a normal operating temperature and below the threshold temperature, the power of the heat dissipated through the secondary heat flow path is substantially equal to the electrical power drawn by the Peltier elements from the supply voltage.

18. The domestic appliance according to claim 17 wherein the electrical power drawn by the Peltier elements is between about 800 W and about 1500 W.

19. The domestic appliance according to claim 17 wherein the electrical power drawn by the Peltier elements is about 1000W.

20. The domestic appliance according to claim 17, wherein the electrical power drawn by the Peltier elements at a maximum temperature is between about 450 W and about 700 W.

21. The domestic appliance according to claim 17, wherein the electrical power drawn by the Peltier elements at a maximum temperature is about 600 W.

22. The domestic appliance according to claim 17 wherein the operating temperature of the Peltier elements is between about 60° C. and about 100° C.

23. The domestic appliance according to claim 17 wherein the operating temperature of the Peltier elements is about 90° C.

24. The domestic appliance according to claim 17 wherein the maximum temperature is between about 120° C. and about 150° C.

25. The domestic appliance according to claim 17 wherein the maximum temperature is about 120° C.

26. The domestic appliance according to claim 17 wherein at an operating temperature the power of the heat removed through the secondary heat flow path is approximately one quarter of the electrical power drawn by the Peltier elements.

27. The domestic appliance according to claim 17 and further comprising at least one thermal leakage path.

28. The domestic appliance according to claim 27 wherein the secondary heat flow path and the thermal leakage path are configured for the removal of heat with a power that is at least equal to the power that the Peltier elements draw at operating temperature.

29. The domestic appliance according to claim 17 wherein the domestic appliance is a tumble dryer.

30. The domestic appliance according to claim 29 wherein said Peltier elements have a cold side and a hot side, said cold side and said hot side both being in direct contact with the primary heat flow path.

31. The domestic appliance according to claim 17 wherein said Peltier elements are not protected by an insulating element.

32. The domestic appliance according to claim 29 wherein said tumble dryer includes a drum and the secondary heat flow path is designed to carry heat away from the drum.

33. A tumble dryer comprising:

a drum for containing items to be dried;

a thermoelectric heat pump including at least one Peltier element drivable by a supply voltage, said at least one Peltier element located outside of said drum, the Peltier element including a hot side that produces heat to be applied to the items to be dried; and a heat flow path, separate from the hot side of the Peltier element, that is structured and positioned such that it does not direct at least a portion of the heat produced by the Peltier element towards the drum and without said portion passing through any conduit that leads to the drum.

34. The tumble dryer according to claim 33 wherein the electrical power drawn by the Peltier element is between about 800 W and about 1500W.

35. The tumble dryer according to claim 33 wherein the electrical power drawn by the Peltier element is about 1000W.

36. The tumble dryer according to claim 33, wherein the electrical power drawn by the Peltier element at a maximum temperature is between about 450 W and about 700 W.

37. The tumble dryer according to claim 33 wherein said Peltier element has a cold side and a hot side, the heat flow path initiating at the hot side and being provided between the hot and cold sides.

38. The tumble dryer according to claim 33 wherein said Peltier element is not protected by an insulating element.

39. The domestic appliance according to claim 14, the domestic appliance further comprising:

a drum having an air entry opening and an air exit opening;

a fan to move air from the air entry opening to the air exit opening;

a first pipe series to connect said hot side of the at least one series of Peltier elements to said air entry opening; and a second pipe series to connect said air exit opening to said cold side of the at least one series of Peltier elements.

40. The domestic appliance according to claim 30, the domestic appliance further comprising:

a drum having an air entry and an air exit;

a blower to move air from the air entry to the air exit;

a first pipe system to connect said hot side of the at least one series of Peltier elements to said air entry opening; and a second pipe system to connect said air exit opening to said cold side of the at least one series of Peltier elements.

* * * * *